US008805268B2

(12) United States Patent
Deguchi et al.

(10) Patent No.: US 8,805,268 B2
(45) Date of Patent: Aug. 12, 2014

(54) IMAGE FORMING APPARATUS AND CARTRIDGE

(75) Inventors: Hideaki Deguchi, Nagoya (JP); Keita Hironaka, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 300 days.

(21) Appl. No.: 13/220,750

(22) Filed: Aug. 30, 2011

(65) Prior Publication Data

US 2012/0051819 A1 Mar. 1, 2012

(30) Foreign Application Priority Data

Aug. 31, 2010 (JP) ..... 2010-194593

(51) Int. Cl.
*G03G 15/14* (2006.01)
*B65H 29/54* (2006.01)

(52) U.S. Cl.
USPC ..... 399/399

(58) Field of Classification Search
USPC ..... 399/399
See application file for complete search history.

(56) References Cited

U.S. PATENT DOCUMENTS

| | | | | | |
|---|---|---|---|---|---|
| 4,060,320 | A | * | 11/1977 | Doi et al. | 399/398 |
| 4,401,382 | A | * | 8/1983 | Minejima et al. | 399/399 |
| 5,617,197 | A | * | 4/1997 | Kawabata et al. | 399/398 |
| 5,837,366 | A | | 11/1998 | Tanaka | |
| 5,909,607 | A | * | 6/1999 | Kikuchi et al. | 399/124 |
| 6,640,070 | B2 | * | 10/2003 | Sanmonji | 399/129 |
| 7,551,883 | B2 | * | 6/2009 | Ide et al. | 399/323 |

FOREIGN PATENT DOCUMENTS

| | | | | | |
|---|---|---|---|---|---|
| JP | 53-139847 | | | 11/1978 | |
| JP | 57053772 | A | * | 3/1982 | G03G 15/14 |
| JP | 02-028675 | | | 1/1990 | |
| JP | 04077777 | A | * | 3/1992 | G03G 15/20 |
| JP | 09171318 | A | * | 6/1997 | B65H 29/54 |
| JP | H09-281810 | A | | 10/1997 | |
| JP | H10-213993 | A | | 8/1998 | |
| JP | 2002132051 | A | * | 5/2002 | G03G 15/14 |
| JP | 2003029564 | A | * | 1/2003 | B65H 29/54 |
| JP | 2005084414 | A | * | 3/2005 | G03G 15/14 |

OTHER PUBLICATIONS

JP Notification of Reason for Refusal mailed Jan. 7, 2014, JP Appln. 2010-194593, English translation.

* cited by examiner

*Primary Examiner* — Nguyen Ha
(74) *Attorney, Agent, or Firm* — Banner & Witcoff, Ltd.

(57) ABSTRACT

A cartridge and an image forming apparatus including the cartridge are provided. The cartridge includes a casing, an image carrier disposed in the casing and configured to be rotated while carrying a developer and transfer the developer onto a recording sheet at a transfer position, and a separating member disposed in the casing and configured to contact the image carrier at a downstream side of a rotating direction of the image carrier with respect to the transfer position to separate the recording sheet from the image carrier. The separating member has a sheet shape including a first surface opposed to the image carrier and a second surface opposite to the first surface. The second surface is roughened by a roughening processing.

8 Claims, 8 Drawing Sheets

FIG. 5

| MATERIAL | PP | | | | | | | |
|---|---|---|---|---|---|---|---|---|
| SANDPAPER (Type) | #100 | #240 | #400 | #800 | #1000 | #1500 | #2000 | REF |
| Ra (unit: μm) | 1.12 | 7.97 | 3.74 | 0.81 | 0.68 | 0.90 | 0.43 | 0.17 |
| TONER ATTACHED PIXEL NUMBER | 13552 | 11518 | 16132 | 7021 | 5179 | 14438 | 3970 | 11733 |

FIG. 7

| MATERIAL | PET | | | | | | | |
|---|---|---|---|---|---|---|---|---|
| SANDPAPER (Type) | #100 | #240 | #400 | #800 | #1000 | #1500 | #2000 | REF |
| Ra (unit: μm) | 7.04 | 10.25 | 1.29 | 2.49 | 1.98 | 0.60 | 0.48 | 0.07 |
| TONER ATTACHED PIXEL NUMBER | 2109 | 3066 | 3142 | 2515 | 2701 | 1366 | 2051 | 6202 |

IMAGE FORMING APPARATUS AND CARTRIDGE

CROSS-REFERENCE TO RELATED APPLICATION

This application claims priority from Japanese Patent Application No. 2010-194593, filed on Aug. 31, 2010, the entire subject matter of which is incorporated herein by reference.

TECHNICAL FIELD

Aspects of the present invention relate to an image forming apparatus and a cartridge having a separating member configured to separate a recording sheet from an image carrier.

BACKGROUND

JP-UM-A-S53-139847 describes an image forming apparatus having a photosensitive drum (image carrier) for carrying a toner image and a separating member configured to separate a sheet attached on the photosensitive drum. According to the image forming apparatus, the separating member is brought into contact with the photosensitive drum, so that a sheet attached on the photosensitive drum is securely separated by the separating member.

SUMMARY

However, when the separating member is brought into contact with the photosensitive drum, toner remaining on the photosensitive drum which is not completely transferred to the sheet from the photosensitive drum is separated by the separating member and left on a surface of the separating member. Accordingly, the toner on the separating member dirties a sheet in a next separation operation.

Accordingly, an aspect of the present invention provides an image forming apparatus and a cartridge which can suppress a developer from remaining on a surface of a separating member, thereby suppressing a recording sheet from being dirtied in a separation operation by the separating member.

According to an illustrative embodiment of the present invention, there is provided a cartridge comprising: a casing; an image carrier disposed in the casing and configured to be rotated while carrying a developer and transfer the developer onto a recording sheet at a transfer position; and a separating member disposed in the easing and configured to contact the image carrier at a downstream side of a rotating direction of the image carrier with respect to the transfer position to separate the recording sheet from the image carrier, wherein the separating member has a sheet shape including a first surface opposed to the image carrier and a second surface opposite to the first surface, and wherein the second surface is roughened by a roughening processing.

According to the above configuration, since it is possible to suppress the developer from remaining on the second surface of the separating member, it is possible to suppress the recording sheet from being dirtied in a separation operation by the separating member.

BRIEF DESCRIPTION OF THE DRAWINGS

The above and other aspects of the present invention will become more apparent and more readily appreciated from the following description of embodiments of the present invention taken in conjunction with the attached drawings, in which:

FIG. 3A shows a state before roughening processing, and FIG. 3B shows a state after the roughening processing;

FIG. 5 is a table showing a test result of the first embodiment

FIG. 7 is a table showing a test result of the second embodiment; and

DETAILED DESCRIPTION

<Overall Configuration of Laser Printer>

Hereinafter, embodiments of the present invention will be described with reference to the drawings.

In the below description, the directions will be described on the basis of a user who uses the laser printer. That is, a left side of FIG. 1 is referred to as a 'front side', a right side is referred to as a 'rear side', a backside is referred to as 'left side' and a front side is referred to as a 'right side.' In addition, the upper and lower directions of FIG. 1 are referred to as 'upper and lower sides.'

Figure 1:
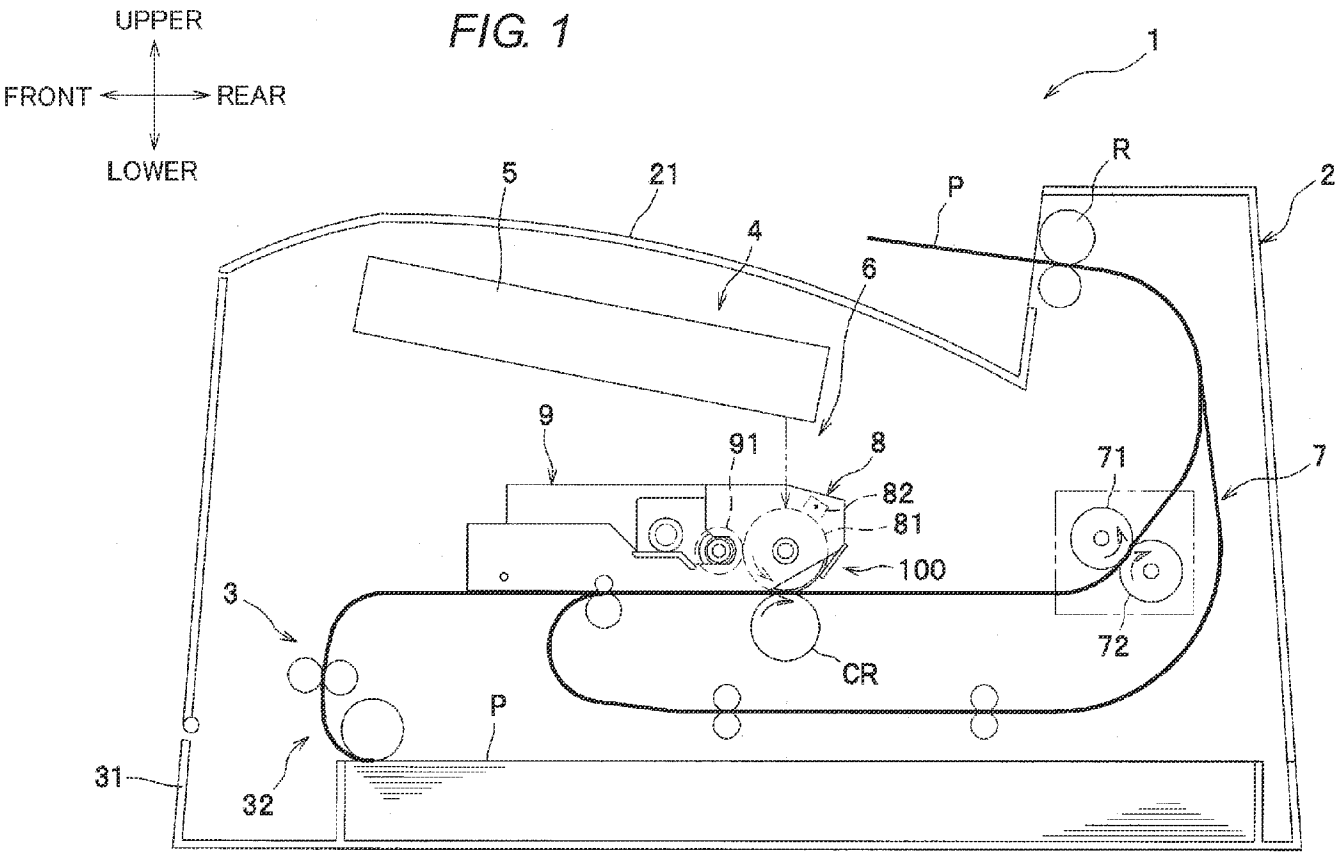
FIG. 1 shows a laser printer according an embodiment of the present invention.

As shown in FIG. 1, a laser printer 1 (an example of an image forming apparatus) has a feeder part 3 that feeds a sheet P (an example of a recording sheet) into an apparatus body 2 and an image forming part 4 that forms an image on the sheet P.

The feeder part 3 mainly has a feeder tray 31 that is detachably mounted at a lower part of the apparatus body 2 and a feeder mechanism 32 that feeds the sheet P in the feeder tray 31 toward the image forming part 4.

The image forming part 4 has a scanner unit 5, a process cartridge 6 (an example of a cartridge), a transfer roller CR (an example of a transfer member), and a fixing device 7.

The scanner unit 5 is provided at an upper part in the apparatus body 2 and has a laser light emitting part, a polygon mirror, a lens, a reflecting mirror and the like, which are not shown. In the scanner unit 5, laser beam is scanned at high speed on a surface of a photosensitive drum 81 (an example of an image carrier), which will be described below.

The process cartridge 6 is detachably mounted to the apparatus body 2 and has a drum cartridge 8 having a photosensitive drum 81 and a charger 82 and a developing cartridge 9 having a developing roller 91 and containing toner (an example of developer). The process cartridge 6 (specifically, drum cartridge 8) is provided with a separation film 100 (an example of a separating member) at a lower part of a rear end side thereof. The separation film 100 will be specifically described below.

In FIG. 1, the separation film 100 is exaggeratingly shown for easily confirming the separation film 100.

In the process cartridge 6, a surface of the photosensitive drum 81 being rotated is uniformly charged by the charger 82 and then exposed by the laser beam emitted from the scanner unit 5. Thereby, a potential of the exposed part is lowered, so that an electrostatic latent image based on image data is formed on the surface of the photosensitive drum 81.

Then, the toner in the developing cartridge 9 is supplied to the electrostatic latent image on the photosensitive drum 81 by the developing roller 91 being rotated, so that a toner image is formed on the surface of the photosensitive drum 81. After that, when the sheet P passes between the photosensitive drum 81 and the transfer roller CR, the photosensitive drum 81 and the transfer roller CR cooperatively operate, so that the toner image carried on the surface of the photosensitive drum 81 is transferred to the sheet P at a transfer position CP (refer to FIG. 2C).

The fixing device 7 has a heating roller 71 and a pressing roller 72 that is opposed to the heating roller 71 and presses the heating roller 72, in the fixing device 7 configured as described above, the toner transferred on the sheet P is heat-fixed while the sheet P passes between the heating roller 71 and the pressing roller 72.

In the meantime, the sheet P that is heat-fixed by the fixing device 7 is conveyed to sheet discharge rollers R provided at downstream from the fixing device 7 and is then discharged to a sheet discharge tray 21 from the sheet discharge rollers R.

<Detailed Structure of Separation Film>

Figure 2A:
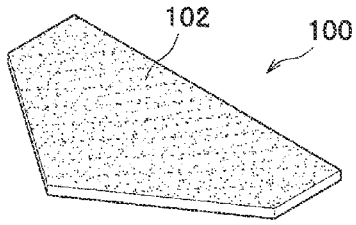
FIG. 2A is a perspective view of a separation film.
Figure 2B:
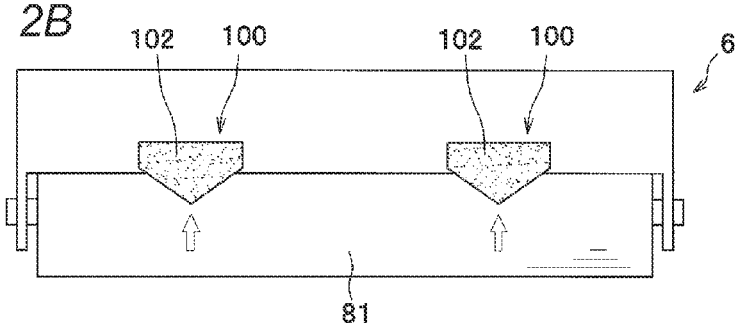
FIG. 2B shows a drum cartridge when seen from the separation film.
Figure 2C:
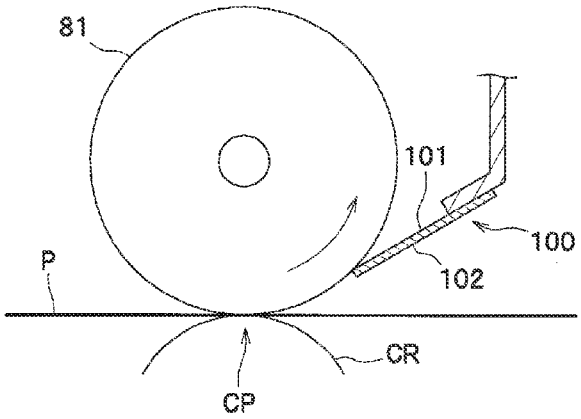
FIG. 2C is a sectional view showing the separation film and a photosensitive drum.

Next, the separation film 100 is specifically described. As shown in FIGS. 2A to 2C, the separation film 100 has a sheet shape and made of resin such as polypropylene (PP), polyethylene terephthalate (PET) and the like. Two separation films are symmetrically provided at left and right sides with respect to a center of the photosensitive drum 81 (center of a direction in a rotational axis). Each separation film 100 is provided to contact the photosensitive drum 81 at a downstream side of a rotational direction of the photosensitive drum 81 than the transfer position CP to separate the sheet P, which is attached on the photosensitive drum 81, from the photosensitive drum 81.

The separation film 100 has a mountain shape with a tapered tip end that is brought into contact with the photosensitive drum 81. The separation film mainly has a first surface 101 opposed to the photosensitive drum 81 and a second surface 102 that is positioned at an opposite side to the first surface 101. The second surface 102 is roughened by a roughening processing using a sandpaper, a metallic file and the like.

Typically, the separation film 100 made of resin is formed through a calendar processing of flattening out a material with a pair of rollers. Accordingly, the first surface 101 and the second surface 102 are respectively formed to be smooth to an extent, on which the respective roller surfaces are transferred. However, in an embodiment of the present invention, among the first surface 101 and the second surface 102 which are formed into a smooth surface, at least the second surface 102, to which the sheet P is contacted, is roughened by the a roughening processing, so that the second surface 102 has a roughened surface. Accordingly the toner is suppressed from being attached on the second surface 102 of the separation film 100.

It is confirmed by a test result that toner is hard to be attached on the second surface 102 which is roughened by a roughening process. The reason is considered as follows.

Figure 3A:
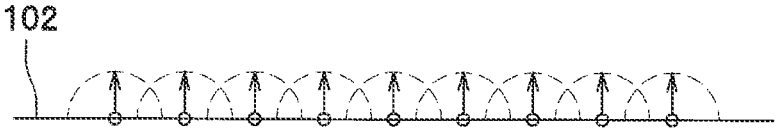
FIGS. 3A and 3B show directions of respective electric fields at a plurality of points on a second surface of the separation film, specifically.
Figure 3B:
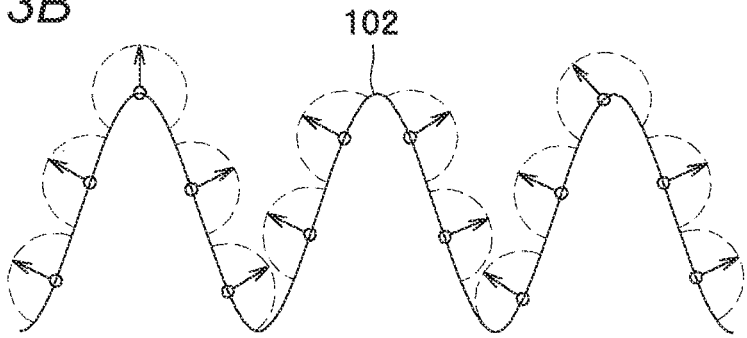

As shown in FIG. 3A, when the second surface 102 is smooth and flat, it is thought that directions of respective electric fields (static electricity) at a plurality of points on the second surface 102 are uniformly oriented in a direction perpendicular to the surface. In contrast, as shown in FIG. 313, when the second surface 102 is roughened, it is thought that directions of respective electric fields at a plurality of points on the second surface 102 are not uniform. Accordingly, when the second surface 102 is roughened, force that attracts the charged toner is weaker, so that the toner is hard to be attached on the second surface 102 which is roughened by a roughening operation.

According to the above configuration, since it is possible to suppress the toner from remaining on the second surface 102 of the separation film 100, it is possible to suppress the sheet P from being dirtied in a separation operation by the separation film 100.

First Embodiment

In the below, a first embodiment is described. Specifically, there will be described a test result which shows a relation between a surface roughness of the second surface of the separation film and an amount of the toner attached on the second surface of the separation film.

Test conditions on the first embodiment are as follows:

(1) Material of the separation film: polypropylene (PP)

Figure 4:
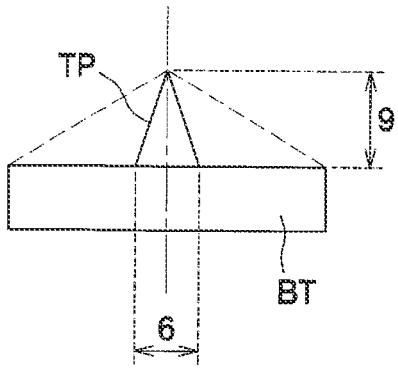
FIG. 4 shows a shape of a test piece in first and second embodiments.

(2) Shape of the separation film: a shape shown in FIG. 4, which includes a triangular part having a base of 6 mm and a height of 9 mm and a rectangular fixing part integrally formed on a bottom side of the triangular part (3) Surface roughness Ra: a plurality of test pieces TP (separation films) are prepared, which have different surface roughness Ra by scrubbing the second surfaces of the separation films with various sandpapers as shown in FIG. 5. Here, the surface roughness Ra was measured by SURFCOM5000DX (Tokyo Seimitsu Co., LTD.). In the table of FIG. 5, "REF" indicates a test piece TP that was not scrubbed by the sandpaper.

[Test Method]

(1) The fixing part is fixed to a housing of a drum unit with a both-sided tape BT with a tip end of the triangular part of the separation film being contacted to the photosensitive drum.

(2) A 1% intermittent print endurance test is performed by 2,000 times. Here, the "1% intermittent print" means an intermittent printing of one page/one job (one page printing in one job) of an image with a printing area of 1%. Here, the 'job' means a series of operations from starting to ending of a printing operation.

(3) After completing the 1% intermittent print endurance test by 2000 times, the separation film is stripped from the housing such that the toner attached on the separation film is not dropped, and is fixed to a white sheet and a transparent cellophane tape is attached thereon, thereby fixing the toner.

(4) The toner on the separation film is scanned as an image by an image scanner:

The image scanner: MFC-8460N image sensor (Brother Industries, Ltd.)

Resolution: True Grey 600×600 dpi (5) A histogram of brightness of pixels of the scanned image is made by Adobe Photoshop (registered trademark), and an area having a level 25 or less of 256 level grey scale is extracted as an 'area having toner attached thereto' and the number of pixels (hereinafter, also referred to as 'number of pixels having toner attached thereto') thereof is calculated.

[Test Result]

Figure 6:
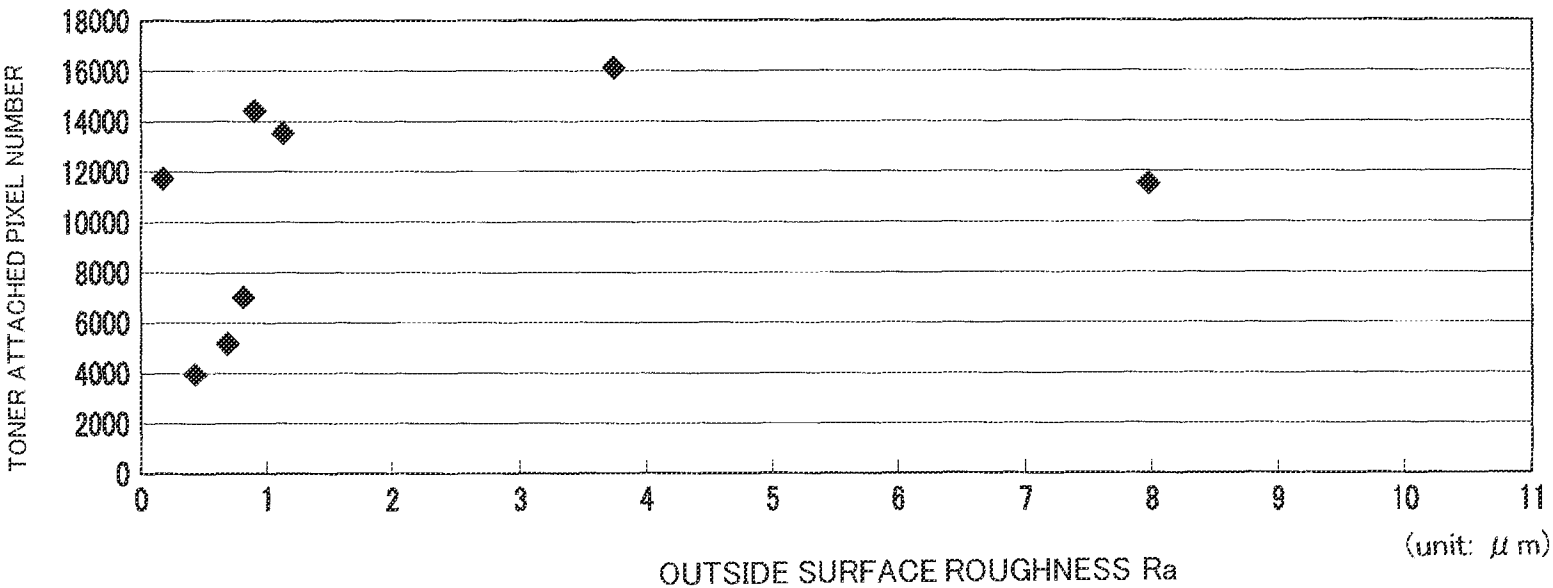
FIG. 6 is a graph showing a test result of the first embodiment.

As shown in FIGS. 5 and 6, it was confirmed that when the separation film is made of PP, the surface roughness is preferably 0.2 μm<Ra<0.9 μm and more preferably 0.43

μm≤Ra≤0.81 μm so as to reduce the number of pixels having toner attached thereto (so that the toner is hard to be attached on the separation film).

When the surface roughness Ra is 0.9 μm or greater, the attachment amount of toner (the number of pixels having toner attached thereto) is increased. That is, when the surface roughness Ra is 0.9 μm or greater, a bottom area of the recessed part, which is caused by the scrubbing, is increased and the bottom surface serves as a flat surface as shown in FIG. 3A. In other words, as the bottom surface of the recessed part becomes flat, the directions of the respective electric fields at the plurality of points on the bottom surface are uniformly oriented in a direction perpendicular to a surface, so that the toner is easily attached on the second surface.

Second Embodiment

Next, a second embodiment is described. The second embodiment is substantially same as the first embodiment, except that the material of the separation film is changed from that of the first embodiment. Specifically; in the second embodiment, the separation film was made of polyethylene terephthalate (PET).

[Test Result]

Figure 8:
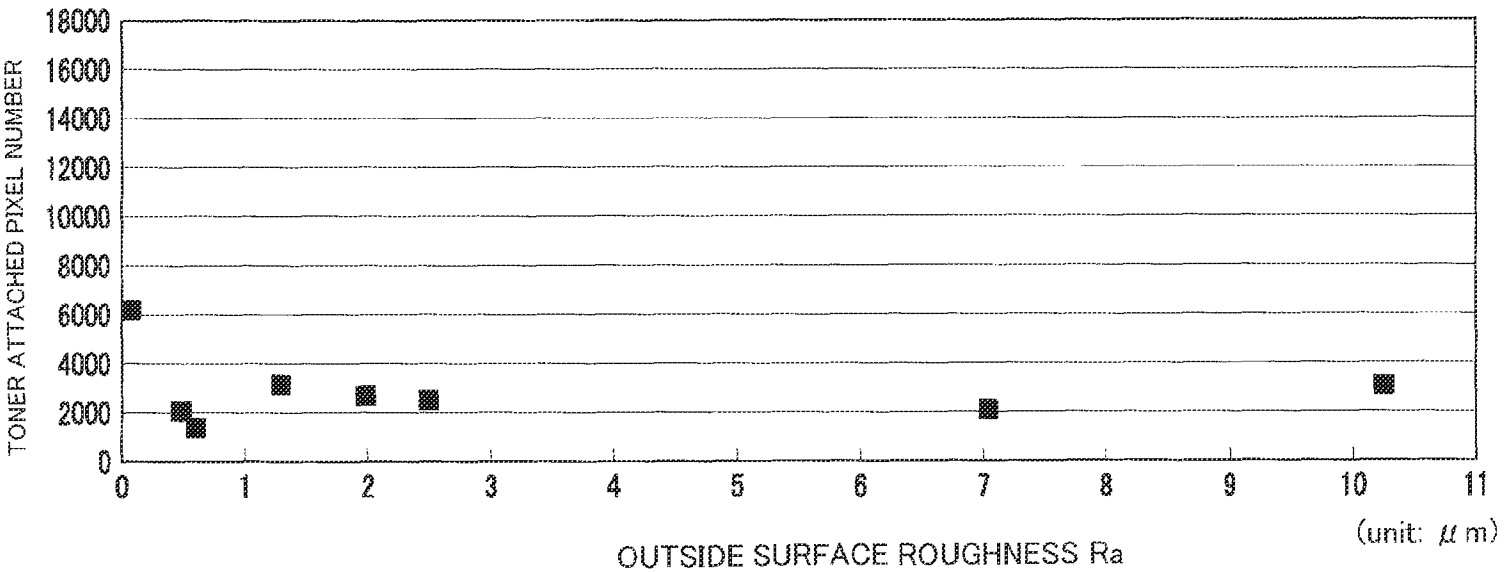
FIG. 8 is a graph showing a test result of the second embodiment.

As shown in FIGS. 7 and 8, it was confirmed that when the separation film is made of PET, the surface roughness is preferably Ra>0.1 μm and more preferably Ra≥0.48 μm so as to reduce the number of pixels having toner attached thereto (so that the toner is hard to be attached on the separation film). In other words, when the separation film was made of PET, it was possible to reduce the attachment amount of toner by at least roughening the separation film (REF) with the sandpaper, irrespective of degree of the surface roughness.

According to the first and second embodiments, when the separation film (REF), which was not scrubbed by the sandpaper, was scrubbed to have an appropriate surface roughness Ra by the sandpaper, it was possible to reduce the attachment amount of toner.

While the present invention has been shown and described with reference to certain embodiments thereof, it will be understood by those skilled in the art that various changes in form and details may be made therein without departing from the spirit and scope of the invention as defined by the appended claims.

In the above embodiments, the tip end of the separation film 100 has an angled shape (V shape). However, the present invention is not limited thereto. For example, the tip end may have a circular shape or a linear shape extending in the axis direction of the photosensitive drum.

In the above embodiments, the process cartridge 6 is exemplified as the image forming unit. However, the present invention is not limited thereto. For example, the image forming unit may be an image forming apparatus such as laser printer 1 and copier. In the meantime, when the image forming unit is an image forming apparatus, the separating member may be fixed to a body housing of the image forming apparatus on that the tip end of the separating member is brought into contact with the photosensitive drum.

In the above embodiments, the transfer roller CR is exemplified as the transfer member. However, the present invention is not limited thereto. For example, any transfer member such as conductive brush, conductive plate spring and the like may be used inasmuch as a transfer bias is applied thereto.

In the above embodiments, the photosensitive drum 81 is exemplified as the image carrier. However, the present invention is not limited thereto. For example, the image carrier may be a belt-type photosensitive member.

In the above embodiments, the separation film 100 that is easily bent has been exemplified as the separating member. However, the present invention is not limited thereto. For example, the separating member may be a member that is difficult to be bent.

In the above embodiments, the sheet P such as cardboard, postcard, thin paper and the like has been exemplified as the recording sheet. However, the present invention is not limited thereto. For example, the recording sheet may be an OHP sheet.

In the above embodiments, the roughening processing is performed by the sandpaper, metallic file and the like. However, the present invention is not limited thereto. For example, the roughening processing may be performed using a shot blasting and the like.

What is claimed is:

1. A cartridge comprising:

a casing;

an image carrier disposed in the casing and configured to be rotated while carrying a developer and transfer the developer onto a recording sheet at a transfer position; and a separating sheet consisting of a single resin, the separating sheet disposed in the casing and configured to contact the image carrier at a downstream side of a rotating direction of the image carrier with respect to the transfer position to separate the recording sheet from the image carrier, wherein the separating sheet includes a first surface opposed to the image carrier which is charged, and a second surface roughened by a roughening processing, the second surface opposite to the first surface and opposed to a charged developer image which is transferred but not yet fixed on the recording sheet, wherein the separating sheet is made of polypropylene, and a surface roughness Ra of the second surface is within a range of 0.2 μm<Ra<0.9 μm.

2. The cartridge according to claim 1, wherein the surface roughness Ra of the second surface is within a range of 0.43 μm≤Ra≤0.81 μm.

3. A cartridge comprising:

a casing;

an image carrier disposed in the casing and configured to be rotated while carrying a developer and transfer the developer onto a recording sheet at a transfer position; and a separating sheet consisting of a single resin, the separating sheet disposed in the casing and configured to contact the image carrier at a downstream side of a rotating direction of the image carrier with respect to the transfer position to separate the recording sheet from the image carrier, wherein the separating sheet includes a first surface opposed to the image carrier which is charged, and a second surface having a roughness greater than a roughness of the first surface, the second surface opposite to the first surface and opposed to a charged developer image which is transferred but not yet fixed on the recording sheet, wherein the separating sheet is made of polypropylene, and a surface roughness Ra of the second surface is within a range of 0.2 μm<Ra<0.9 μm.

4. The cartridge according to claim 3, wherein the surface roughness Ra of the second surface is within a range of 0.43 μm≤Ra≤0.81 μm.

5. An image forming apparatus comprising:

a main body having a casing;

an image carrier disposed in the casing and configured to be rotated while carrying a developer and transfer a developer image onto a recording sheet at a transfer position; and a separating sheet consisting of a single resin, the separating sheet disposed in the casing and configured to contact the image carrier at a downstream side of a rotating direction of the image carrier with respect to the transfer position to separate the recording sheet from the image carrier, wherein the separating sheet includes a first surface opposed to the image carrier which is charged, and a second surface roughened by a roughening processing, the second surface opposite to the first surface and opposed to a charged developer image which is transferred but not yet fixed on the recording sheet, wherein the separating sheet is made of polypropylene, and a surface roughness Ra of the second surface is within a range of 0.2 μm<Ra<0.9 μm.

6. The image forming apparatus according to claim 5, wherein the surface roughness Ra of the second surface is within a range of 0.43 μm≤Ra≤0.81 μm.

7. A cartridge comprising:

a casing;

an image carrier disposed in the casing and configured to be rotated while carrying a developer and transfer the developer onto a recording sheet at a transfer position; and a separating member disposed in the casing and configured to contact the image carrier at a downstream side of a rotating direction of the image carrier with respect to the transfer position to separate the recording sheet from the image carrier, wherein the separating member has a sheet shape including a first surface opposed to the image carrier and a second surface opposite to the first surface, wherein the second surface is roughened by a roughening processing, and wherein the separating member is made of polypropylene, and a surface roughness Ra of the second surface is within a range of 0.2 μm<Ra<0.9 μm.

8. The cartridge according to claim 7, wherein the surface roughness Ra of the second surface is within a range of 0.43 μm≤Ra≤0.81 μm.

* * * * *